US005169278A

United States Patent [19]

Hoechst et al.

[11] Patent Number: 5,169,278

[45] Date of Patent: Dec. 8, 1992

[54] VERTICAL LIFT LOADER BOOM

[75] Inventors: Lonnie D. Hoechst, Gwinner; Orlan J. Loraas; Wally L. Kaczmarski, both of Lisbon; Larry E. Albright, Gwinner, all of N. Dak.

[73] Assignee: Clark Equipment Company, South Bend, Ind.

[21] Appl. No.: 794,343

[22] Filed: Nov. 12, 1991

Related U.S. Application Data

[63] Continuation of Ser. No. 577,645, Sep. 5, 1990, abandoned.

[51] Int. Cl.[5] ..... E02F 3/627

[52] U.S. Cl. ..... 414/685; 414/686

[58] Field of Search ..... 414/685, 686, 697, 700, 414/680

[56] References Cited

U.S. PATENT DOCUMENTS

| | | | |
|---|---|---|---|
| 1,863,696 | 6/1932 | North et al. . | |
| 2,310,284 | 2/1943 | Gurries . | |
| 2,345,620 | 4/1944 | Mork . | |
| 2,372,220 | 3/1945 | Mork . | |
| 2,849,132 | 8/1958 | Clarke . | |
| 2,980,271 | 4/1961 | Ulinski . | |
| 3,215,292 | 11/1965 | Halls . | |
| 3,352,441 | 11/1967 | Alden . | |
| 3,522,898 | 8/1970 | Rotheisler . | |
| 3,586,195 | 6/1971 | Beltrami . | |
| 4,122,960 | 10/1978 | Bauer et al. | 414/697 |
| 4,355,946 | 10/1982 | Wykhuis et al. | 414/707 |
| 4,427,334 | 1/1984 | Copie et al. | 414/710 |
| 4,636,133 | 1/1987 | Hess | 414/715 |
| 4,699,560 | 10/1987 | Ostermeyer et al. | 414/696 |

FOREIGN PATENT DOCUMENTS 85419 6/1965 France .

OTHER PUBLICATIONS

Beltrami Prototype, Melroe Business Unit of Clark Equipment Company.

Title page, table of contents and pp. 72–77 from book entitled "Mechanisms, Linkages and Mechanical Controls," edited by Nicholas P. Chironis (McGraw-Hill 1965).

*Primary Examiner*—F. J. Bartuska
*Assistant Examiner*—Donald W. Underwood
*Attorney, Agent, or Firm*—Kinney & Lange

[57] ABSTRACT

A loader boom assembly has articulated lift arms that have first and second lift arm sections pivotally mounted together. The rear lift arm section is pivotally mounted to rear portions of a prime mover frame. The main lift arm section is substantially longer than the first lift arm section and pivots on the outer end of the rear lift arm link. The lift arm sections are in a folded position when the lift arms are lowered, and a control link is provided to cause the lift arms to unfold as the lift arms are raised to keep the forward portion of the main lift arm section moving along a generally vertical path after a selected lift height to provide a better forward reach of the boom assembly at the higher range of lift. The proportional lengths of the lift arm sections and the control link and the placement of the pivot points and actuators on the main frame also provide structural integrity and efficient power utilization.

16 Claims, 3 Drawing Sheets

10
12
14
15
16
18
20
22
24
26
28
30
32
38
40
42
46
47
48
50
52
54
58
60
62
66
68
70
74

VERTICAL LIFT LOADER BOOM

BACKGROUND OF THE INVENTION

The present invention relates to loader boom assemblies for self-propelled loaders which are controlled to maintain the forward ends of the boom assembly in a generally vertically linear path throughout a substantial portion of the upward travel of the boom assembly.

Loader boom assemblies which provide a generally vertical movement of a bucket used for lifting material have been used. For example U.S. Pat. No. 4,355,946 illustrates a lift arm control linkage structure for a loader which uses a long lift arm support link at the rear portions of the loader boom assembly, to provide an altered upward path of a front bucket, and at the same time provides bucket leveling.

U.S. Pat. No. 3,215,292 issued to Halls on Nov. 2, 1965 illustrates guide links which operate to cause lift arms of a loader to extend out at the same time they are raised. However, in this unit the bucket continually moves outward from the supporting machine as the bucket raises, rather than moving on a generally vertical path in the upper portions of the range of movement.

SUMMARY OF THE INVENTION

The present invention relates to a boom assembly for a loader which comprises a pair of lift arms, each including a pair of articulated links which are controlled in movement as the lift arms are raised to cause the outer ends of the lift arms to move generally vertically and substantially linearly when the lift arms are raised beyond a horizontal position. The articulated links of each lift arm include a main forwardly extending lift arm link or section and a rear, substantially shorter lift arm link or section which has one end pivoted to the main lift arm link or section and the other end pivoted to the self propelled loader frame.

The path of movement of the main lift arm sections is partially controlled by a control link that is connected to the self propelled loader frame at a forward end of the frame and to the lift arm main section of the respective lift arm. The lift arms are raised by operating hydraulic cylinders or actuators which react forces between the main lift arm sections and the loader main frame. As the boom assembly is raised the rear lift arm link first is controlled to pivot about its pivot at the main loader frame so as to move the other or first end of the rear link which is pivoted to the main lift arm link rearwardly under control of the control link. After the bucket at the forward end of the boom assembly is about level with the pivot of the rear lift arm link to the loader main frame the one end of the rear lift arm section or link starts to move forwardly as the boom assembly is raised further, and the main lift arm sections also move forwardly so that the rear and main lift arm links or sections unfold as the boom assembly is raised, to keep the forward ends of the lift arms and bucket moving in a generally vertical path throughout the range of higher movements of the lift arms forming the boom assembly.

This positions the bucket support at the front ends of the lift arms for easier dumping of material into a truck, for example, and has the advantage of not having the forward ends of the lift arms move rearwardly in an arc during the upper portions of lift movement of the lift arms.

Both sections of each loader lift arm, the hydraulic actuator and the control link for the respective lift arm, are made to be in a common plane so that the lateral dimensions of the operators compartment do not have to be changed from existing dimensions of skid steer loaders with conventional booms.

DETAILED DESCRIPTION OF THE PREFERRED EMBODIMENTS

Figure 1:
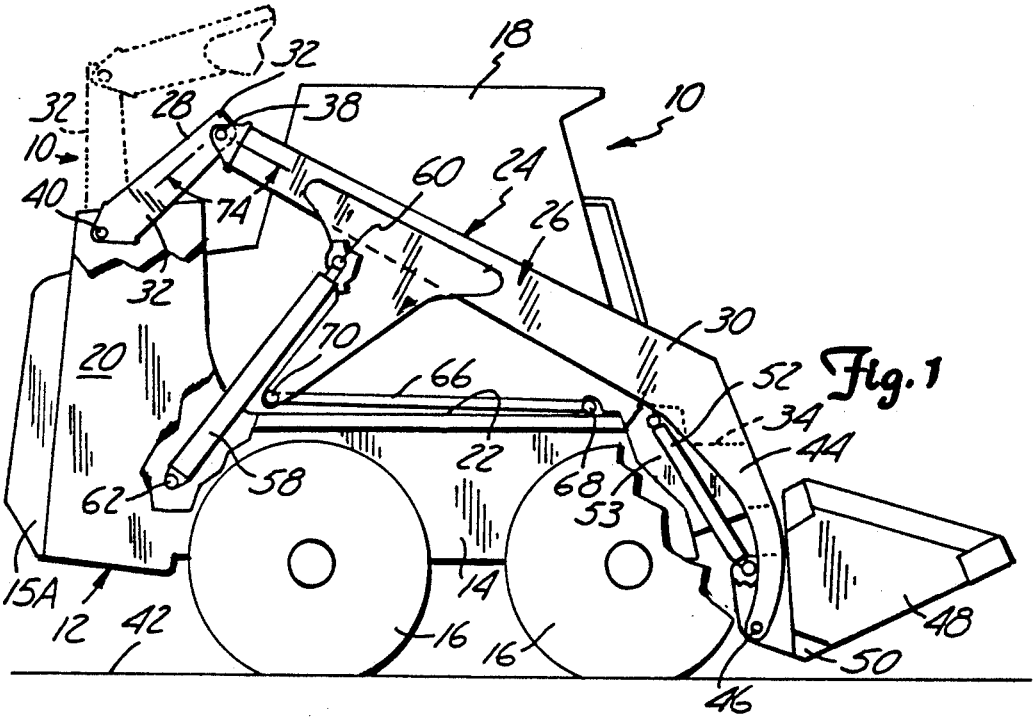
FIG. 1 is a schematic side elevational view of a skid steer loader having a loader boom assembly made according to the present invention installed thereon with parts broken away.
Figure 2:
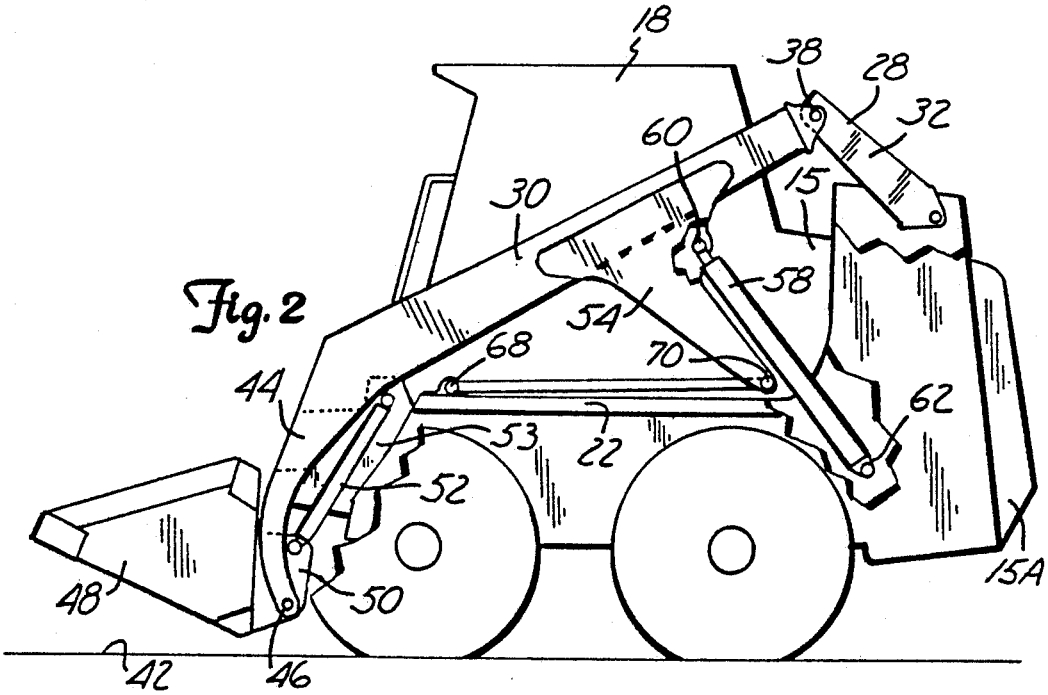
FIG. 2 is a side elevational view of the loader of FIG. 1, taken from the opposite side.

A loader assembly indicated generally at 10, made according to the present invention, is mounted onto a skid steer machine or prime mover 12 that has a main frame 14 that extends longitudinally in fore and aft direction, and is supported suitably on front and rear wheels 16. Wheels 16 are driven in a suitable manner through a drive train supported on the main frame 14, from an engine (not shown) in an engine compartment 15 mounted directly behind an operator's compartment indicated schematically at 18. Frame uprights 20 at the rear portion of the main frame are used for supporting the loader 10. Each of the uprights 20 comprises a part of spaced apart plates.

It is known that when conventional loader booms, mounted at a single pivot axis to the loader frame are raised and lowered, the outer forward ends travel in an arc, and when the boom starts to raise, there is some forward movement of a supported bucket and, after the pivoting boom goes over center, there is a substantial amount of rearward movement of the bucket, as well as upward movement, which tends to shorten the forward "reach" of a bucket with the boom assembly in a raised position.

Figure 4:
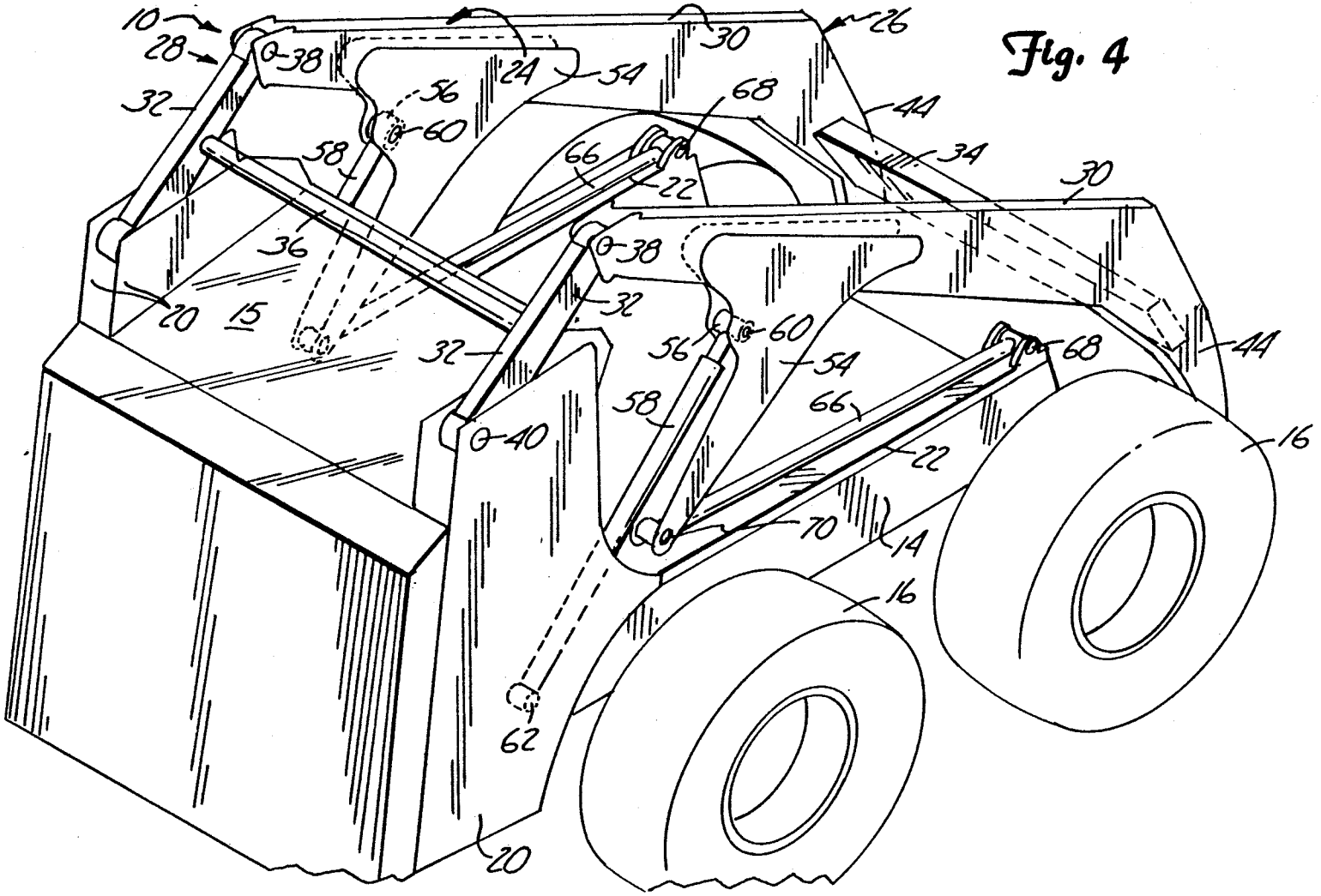
FIG. 4 is a schematic perspective view of the loader boom assembly shown in FIG. 1 with the skid steer loader plain frame also shown, but with other parts removed for sake of clarity.

The main frame 14, frame uprights 20, the drive wheel configuration, fenders 22, and wide operator's compartment 18 are all features of the standard skid steer loaders. The operator's compartment extends laterally across the entire main frame. The operator's compartment extends substantially the full width between the inner plates of frame uprights 20 and fenders 22 (see FIG. 4). The present articulated boom is designed to fit onto the basic construction of the main frame, uprights and wide cab while permitting the usual access to service the machine in the same manner. An engine compartment 15 is immediately behind the compartment 18 and the engine access door or panel 15A can be opened in the same manner as on existing machines because of the lack of interference from the rear links 32 and clearance of cross member 36 due to use of high pivots 40.

The high rear pivot of existing machines is maintained, in order to accomplish the purposes of using the basic loader design of conventional radius arc booms.

Skid steer loaders of the general type shown herein are well known and are manufactured by the Melroe Company, a business unit of Clark Equipment Company of Fargo, N.D., and are marketed under the registered trademark BOBCAT.

The loader 10 includes a lift boom assembly 24, which is, in the preferred embodiment, a two section boom. The two section boom includes a main lift arm assembly 26 and a rear lift arm link assembly 28, which are pivotally mounted together. The main lift arm assembly 26 includes a pair of laterally spaced main lift arm, links or sections 30, and a pair of rear or second lift arm links or sections 32. The main lift arm links 30 are on opposite sides of the main frame connected with suitable cross members at the forward ends thereof, for example with a cross member shown at 34, and the spaced rear lift arm links 32 on opposite sides of the main frame are connected together with a suitable cross member 36. The main lift arm assembly 26 has forward and rear ends, and at its rear end the main lift arm sections are each pivotally connected with suitable pivot pins 38, forming a pivot axis, to first ends of the rear lift arm links 32. The connection is made so the main lift arm sections 30 and the rear lift arm links 32 lie on a common plane along the side of the operators compartment.

In addition, each of the rear lift arm links 32 is pivotally connected on suitable pins 40 forming a pivot axis to the respective frame uprights 20, adjacent the rear portions of the main frame 14, and at the upper portions of the upright and between the plates forming the respective frame uprights 20. The axis of the pins 40, which define the pivoting axis of the rear lift arm link assembly is raised a substantial distance above a supporting surface indicated generally at 42. The main lift arm sections 30 include downwardly extending forward arms 44 thereon, which extend downwardly and forwardly, just ahead of the forward wheels 16, with the lift boom assembly 24 in a lowered position. At the forward ends of the main lift arm sections 30 there is an attachment pin 46 which defines a pivot axis for supporting a working implement. As shown, the working implement is a bucket 48 that is supported on a subframe 50. The subframe in turn is pivotally mounted on the pins 46, and is controlled by a tilt cylinder or actuator illustrated schematically at 52, in a conventional manner. The tilt cylinder 52 is connected at its based end to a support 53 which is mounted on cross member 44. The subframe 50 is an attachment frame that is sold by Melroe Company, a business unit of Clark Equipment Company, located at Fargo, N.D., under the trademark BOB-TACH. Of course, any desired mounting for the implement or bucket 48 can be utilized, and in most instances there is a defined point such as the axis of pin 46 or the front lip of the bucket 48 that can be used for determining the path of movement of the forward ends of the main lift arms 30 during raising and lowering motion.

In this form of the invention, the main lift arm sections or links 30, have control arms 54 fixed thereto, at a location spaced forwardly from the pivot pin 38. The control arms 54 are made of two spaced plates and extend downwardly along the sides of the operator's compartment 18, as can be seen, to a location just above the fenders 22. Hydraulic actuator or cylinder attachment plate sections 56 are secured to the main lift arm section 30 on each side of the boom assembly in a suitable manner, or can be part of the plates forming control arms 54.

A separate double acting hydraulic actuator or cylinder assembly 58 is mounted on each of the sides of the main frame, and has a rod that is extendable and retractable. The rod has a rod end that is connected with a suitable pin 60 between the respective spaced plates 56. The base end of each actuator or cylinder 58 is connected with a suitable pin 62 to the main frame 14 and, as shown, is located between the plates forming uprights 20. It should be noted that the base end pin 62 for the double acting hydraulic actuator or cylinder 58 is substantially lower than the pivot pins 40. The actuator extends upwardly and forwardly from the pivot pin 62 to pin 60.

A control link, which in the form of the invention is a fixed length or rigid link, is indicated generally at 66. There is a rigid control link on each side of the main frame 14, and thus there is a separate control link 66 for each of the lift arm of the boom assembly. Each of the links 66 has a forward end pivotally mounted with a suitable pin 68 to a bracket fixed on the respective fender 22 and thus to main frame 14 of machine 12. The opposite end of the rigid link 66 is connected with a suitable pin 70 to an end of the respective control arm 54 on each of the main lift arm sections 30 and is positioned between the plates forming the respective control arm 54.

Each link 66 is substantially horizontal with the boom assembly 24 in its lowered position. When working with a bucket and the like, there is a rearward force on the boom assembly during the loading of the bucket. The horizontal links 66 are substantially parallel to the direction of rearward force and will tend to hold each of the individual main lift arm sections 30 and rear lift arm links 32 from rearward movement. Part of this rearward load of course will also be transferred through the pins 38 to the rear lift arm links 32 and thus to the pivot 40 on the frame uprights, but with the articulated lift arms, that is, two lift arm sections pivoted together, there would be a tendency to cause folding of the main lift arm sections and rear lift arm links from horizontal load vectors acting rearwardly against the pin 46. The links 66, actuator 58, the main lift arm section 30, and the rear lift arm section or link on each side of the boom assembly lie in a common plane to save lateral space and to fit existing skid steer machines without reducing the width of the operator's compartment or increase the overall width of the machine.

Figure 3:
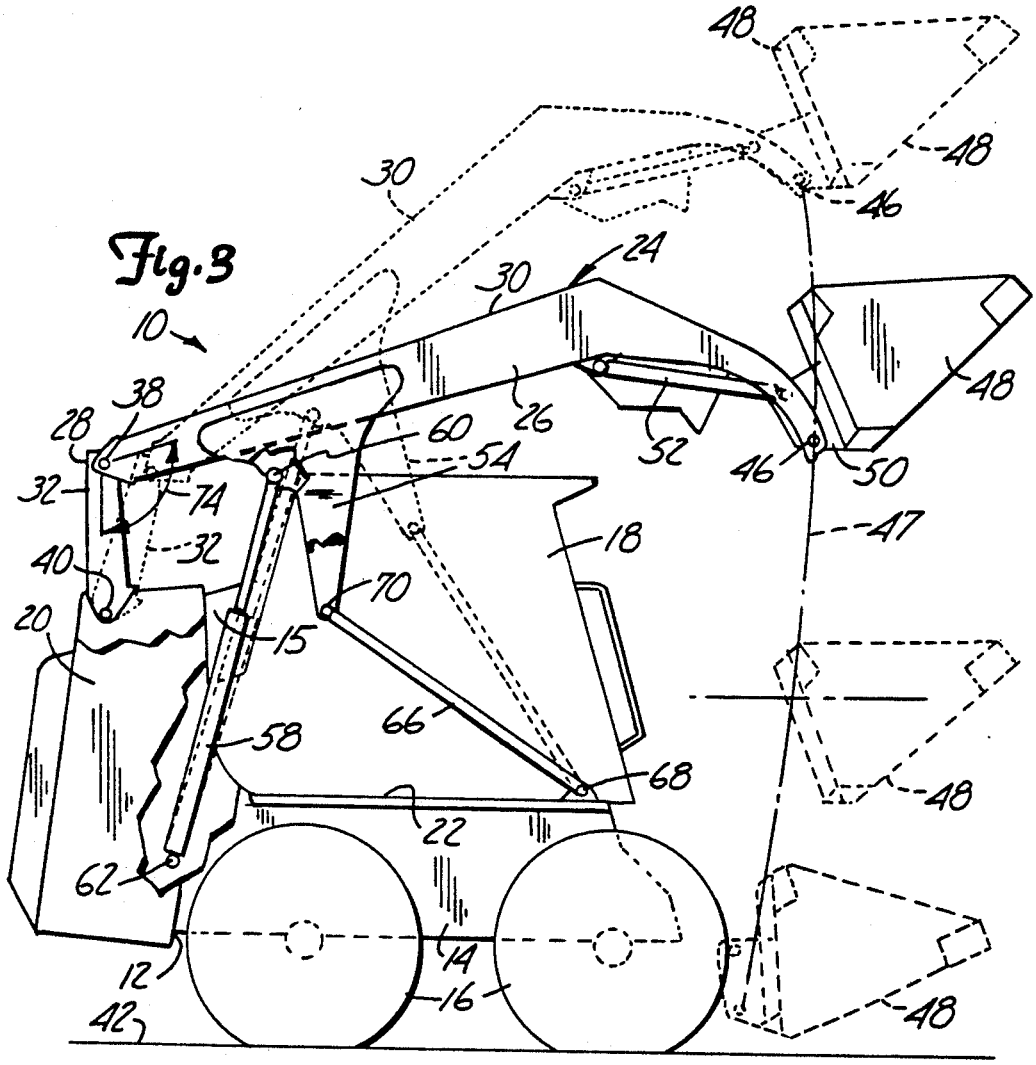
FIG. 3 is a part-schematic side elevational view, showing a bucket and boom assembly in a plurality of raised positions to illustrate the path of movement of the outer ends of the boom assembly and a supported bucket.

The actuators or cylinder assemblies 58 can be operated using a valve and a source of hydraulic pressure (not shown) to raise the boom assembly 24 to a raised, dumping position. As the boom assembly raises, the path of travel of the axis of the pin 46, or front edge of the bucket will define a substantially vertical path throughout the upper part of the working range used for dumping of buckets. Referring to FIG. 1, the boom assembly 24 is shown at its lowered position. In FIG. 3, the path of movement of the pin 46 is illustrated, and after the pin 46 reaches a height above the support surface 42 substantially equal to the level of the pin 40 (as shown by a horizontal dashed line in FIG. 3), instead of moving on an arc rearwardly at the same time that the lift arms are raised further, the axis of the pin 46 moves substantially vertically to the full raised position of the lift arms. The tilt cylinder 52 can be operated as desired for tilting the subframe 50 and the bucket 48 about the axis of pins 46, in the usual manner. It also follows that in any particular tilted position of the bucket 48, each point of the bucket, such as the leading edge, will move along a path corresponding to the path of the axis of the pin 46.

In the lowered position of the boom assembly 24, the main lift arm section or link 30 and the rear lift arm section or link 32 on each side of the loader form an included acute angle between the center line of the rear link 32, between the axes of pivot pins 38 and 40, and the line between the axes of pivot pin 38 and pin 46. This included angle is represented by the double arrow 74. As the lift cylinder or actuator 58 is operated to start to raise the boom assembly 24 and, therefore, the bucket 48, the included angle represented at 74 will first decrease as the rear lift arm links 32 will be forced to move rearwardly by the rigid link 66, which pivots about pin 68 in an upward arc.

The control arm 54 positions the pivot pin 70 for the rear end of link 66 in a location such that rearward movement of the lift arm link 32 occurs as the arms swing. Pin 46 then moves upwardly along a path 47 that is shown in FIG. 3, and when the cylinder or actuator 58 has been extended to a point where the boom assembly 24 is about one-third of its total upward travel the included angle indicated by arrow 74 stops decreasing, and then starts increasing again as the two lift arm sections, comprising the main lift arm section or link 30 and the rear lift arm section or link 32 start to unfold as the end of link 66 moves forward on an arc. The effective length of the boom assembly 24 from pivot pin 40 to the front end increases during the upper two-thirds of its upward travel to cause the vertical path of movement of the pin 46 and associated parts of the bucket. The rigid control link 66 thus controls the path of pivotal movement of the pivot pin 38 as lift arm link 32 pivots about the pin 40. By proper selection of the link geometry, including the length of the link 66 to be of a substantial length, and approximately twice the length of the rear lift arm link 32, and keeping rear lift arm link 32 much shorter than lift arm link or section 30, the desired path of travel of the pin 46 and bucket 48 can be achieved.

The same path of travel is followed when the lift arms are lowered, because the control link 66 is fixed in length. The present boom assembly achieves the objective of having a longer reach in the upper portions of the path of movement of the boom assembly so that it is easier to dump a bucket into a truck, and also that it is easier to make a pile that is higher, while maintaining the advantages of having a high pivot boom point 40 that is present in existing skid steer loaders, improved lifting capacity, and still having a compact loader which is as maneuverable as the prior skid steer loaders.

The plane defined by the axes of pins 68 and 70 is above the axes of the pin 62 for the lift cylinders or actuators 58, and the pin 70 is rearwardly of the pin 68 so that from the generally horizontal position of link 66 with the boom lowered, the pin 70 will move upwardly and forwardly which will cause the rear link 32 to first move rearwardly. The axis of pin 70 crosses a plane defined by the axis of pins 68 and 38 and goes "overcenter" as it raises. At a selected raised position of the main lift arm sections, the rigid link 66 will cause the rear or second lift arm links to start to move forwardly as the main lift arm sections are further raised, again causing the included angle indicated by arrow 74 to start to increase. The effective length of the boom assembly comprising the main lift arm sections or links 30 and the rear lift arm links 32 increases as raising continues.

It should be noted that the link 66 could be made adjustable in length to suit individual conditions that are desired for the path of movement, and provide for different control paths of the pin 46. However, the mechanical linkage illustrated herein provides the desirable vertical path of movement of the pin 46 when the bucket has been raised to a desired level. In other words, the bucket raised along a substantially vertical path after it has reached a desired level near the level of the pivot axis of pin 40.

The loader assembly with the short rear lift arm links, that are mounted on a high pivot improves the rigidity of the lift boom assembly 24 so the lift arms travel in a definite path with clearance maintained along the sides of the operator's compartment. The rear lift arm links 32, mounted on the high pivot 40 to the frame uprights 20, provides a boom assembly having the benefits of an articulated boom without extending into the space needed for the rear engine compartment opening, so that there is good service access for the engine compartment. It does not extend rearwardly beyond the rear access door 15A of the engine compartment 15. The articulated boom loader of the present invention has a large degree of commonality of basic frame and drive structure with conventional skid steer loaders.

The path of movement of the bucket 48, and the forward ends of the lift arms, as stated, is such that the rear lift arm links 32 move rearwardly upon initial lifting, as guided by the rigid links 66. This tends to move the bucket in a more vertical path initially, so that the bucket 48 and its load stay close to the front tires and front of the main frame 14 as the bucket is first lifted, rather than moving out on a radius. Thus, the rearward movement of the rear lift arm links has important features in defining the initial lifting path of the bucket.

CONCLUSION

The present invention provides a vertical lift path in the range of movement of a loader boom where the reach of the boom normally is reduced. This permits the operation of the loader in filling trucks and piling material to proceed more easily. The control linkage provides a positive and reliable control for obtaining the vertical path of movement.

The present invention provides a vertical lift path in the range of movement of a radial arc boom machine where the reach of the boom normally increases or moves forwardly.

This mechanical linkage system of providing both inward movement initially and increased reach near full lift height can be packaged on a conventional skid steer machine design. This maintains the existing features of machine design, production processes, and field service procedures in the areas of operator compartment, controls, engine, transmission, hydraulics and hydrostatics, cooling system, electrical system, service access features and means of connecting attachment tools to the skid steer machine.

Although the present invention has been described with reference to the preferred embodiments, those skilled in the art will recognize that changes may be made in form and detail without departing from the spirit and scope of the invention.

What is claimed is:

1. A lift boom assembly for a loader on a prime mover having a longitudinal main frame having boom supports fixedly attached to the frame at the rear of the frame, said boom supports having upper ends, a pair of lift arms located at opposite sides of the frame and coupled together to move as a lift arm assembly, said lift arm assembly having a forward end attachment for mounting a working tool and a rearward end, said pair of lift arms each comprising first and second articulated lift arm links, including a main lift arm link extending from the forward portion of the frame rearwardly, and a second lift arm link shorter than the main lift arm link having a first end pivotally mounted to a rearward end of the main lift arm link and having a second end pivotally mounted to the upper ends of the boom supports substantially above a supporting surface for the main frame, extensible and retractable power actuator means having a first ends pivotally mounted to the main frame and extending upwardly and forwardly and being coupled to the main lift arm links, respectively, and a control link that is longer than the second lift arm links connected to at least one main lift arm link for controlling the path of movement of the pivot between the main lift arm links and the respective second lift arm links as the lift arms are raised and lowered, said control link having a first end pivotally mounted to the main frame adjacent forward portions of the main frame and having a second end extending rearwardly and pivotally connected to the main lift arm link, the control link being at a position above the pivotal mounting of the actuator means to the main frame and below the pivotal mountings of the second lift arm links when the lift arms are in a lowered position whereby the second pivot of the control link moves along an arc as the lift arm assembly is raised by the actuator means and the pivot between each main lift arm link and its respective second link moves in a controlled path which effectively retracts and extends the overall length of the two lift arm links of each lift arm as the boom assembly is raised to a desired position.

2. The lift boom assembly of claim 1 wherein each said second link extends upwardly and forwardly from its pivot to the upright supports to its pivot to its main lift arm link with the main lift arm link in a lowered position, and has a first included angle with respect to the main lift arm link in a lowered position, and wherein the control link causes the second link to pivot rearwardly so the first included angle decreases under control of the control link as the main lift arm link is first raised and after the lift arm assembly is raised to the desired position to the pivot at the second end of the control link goes over center with respect to a plane defined by the pivots at the second ends of the second links and the first end of the control link and the first included angle increases.

3. The lift boom assembly of claim 1 wherein said control link is pivotally mounted to the main lift arm link through a second arm fixed to the main lift arm link which places the pivot point between the control link and the main lift arm link substantially offset downwardly from the pivotal connection between the main lift arm link and the second link on each side of the lift arm assembly.

4. The lift boom assembly of claim 1, wherein the main lift arm link and the second link are in a folded position with the main lift arm link in the lowered position, the control link being substantially longer than the second lift arm links and as the actuator means moves the main lift arm links upwardly the main and second lift arm links first fold together and subsequently unfold as the control link goes over center with respect to the pivot of the first end of the control link and the pivot axis between the second and main lift arm links to cause the forward ends of the main lift arm links to move on a substantially straight line upright path as the lift arm assembly is raised above the desired level.

5. The lift boom assembly of claim 1 wherein the main and second lift arm links, the hydraulic actuator means, and the control link on each side of the lift arm assembly lie in a common plane and overlie a side portion of the main frame.

6. A loader assembly for a self-propelled prime mover having a main frame which extends longitudinally and has forward and rear ends, and having upright loader boom supports at a rear of the main frame comprising:

a loader boom assembly comprising a pair of lift arms, one on each side of the main frame, each of said lift arms being articulated and including first and second lift arm sections, the first lift arm sections form in a boom unit and the second lift arm sections forming a rear link unit and being pivotally mounted to the first lift arm sections and to the rear portions of the upright loader boom supports on the main frame so that the second lift arm sections extend upwardly and forwardly from their pivots to the upright loader boom supports and so that the respective first and second lift arm sections will pivot relative to each other to fold and unfold, the second lift arm sections being substantially sorter than the first lift arm sections, and the first lift arm sections extending from adjacent the rear portions of the main frame to the forward end of the main frame and having means for supporting a working tool at attachment points adjacent forward ends thereof;

actuator means connected between the first lift arm sections an the main frame for providing force to raise the forward ends of the first lift arm sections form a lowered position upwardly to a raised position; and a control link having a first end pivotally mounted adjacent the front portions of the main frame at a first pivot and extending rearwardly, and having a second end pivotally mounted to a first lift arm section at a second pivot, the control link being positioned above the connection of the actuator means to the main frame and below the pivotal mountings of the second lift arm section with the loader boom assembly in a lowered position, the second pivot being in a position and the control link having a length such that the control link causes the first and second lift arm sections to follow a path as the first lift arm sections are raised to maintaining the forward ends of the first lift arm sections in a path that is substantially vertical between a lowered and a raised position.

7. The loader assembly of claim 6 wherein said control link is pivotally mounted to the main frame at a vertical level substantially below the pivot between the second lift arm sections and the upright loader boom supports, and moves from a position of being substantially horizontal with the first lift arm sections in the lowered position and as the first lift arm sections move upwardly causing the first and second lift arm sections to pivot relative to each other to first decrease and then increase the effective length of the arc of movement of the forward ends of the first lift arm sections as measured between the pivot of the second lift arm sections to the upright loader loom supports and the forward ends of the first lift arm sections ,the control link being substantially longer than the second lift arm sections.

8. The loader assembly of claim 6 wherein the control link is substantially horizontal with the loader boom assembly in its lower most position.

9. The loader assembly of claim 6 wherein the control link second pivot is below a plane defined by axes f pivot between the first and second lift arm sections and the pivotal mount of the first end of the control ink, with the loader boom assembly in its lowered position, and wherein the control link second pivot moves above the plane as the loader boom assembly is moved to a raised position.

10. The loader assembly of claim 9 wherein the pivot of the second lift arm section to the upright loader boom supports is a substantial distance above a supporting surface for the prime mover, and the pivot of the first end of the control link and the length of the control link being such that the second pivot moves above the plane when an attachment point for tools at a forward end of the lift arms is at a desired level generally above of the level of the pivot of the second lift arm sections to the upright loader boom supports.

11. A skid steer loader having a longitudinally extending main frame, wheels for supporting the main frame for movement over the ground, an operator's compartment spanning substantially the entire lateral distance of the main frame in fore and aft midportions thereof, and a pair of rear frame uprights extending above and fixed to the main frame adjacent lateral sides of the operator's compartment, the improvement comprising a loader boom assembly comprising first and second articulated lift arm link assemblies pivotally connected together adjacent the rear portion of the main frame, said lift arm link assemblies comprising a separate pair of lift arms adjacent each of the lateral sides of the main frame, a first of said lift arm link assemblies extending forwardly of the main frame for supporting a working tool at a forward end thereof, and a second of said link assemblies having its rear end pivotally mounted to upper portions of the frame uprights, a pair of hydraulic actuators coupled between the main frame and the lift arms of the first lift arm link assembly for raising and lowering the loader boom assembly, and a pair of control inks, said control inks being on opposite sides of said operator's compartment and forwardly of the hydraulic actuators, each control link having a first end pivotally connected to forward points of the main frame and each control link extending rearwardly and having a second end pivotally connected to the respective lift arms of the lift arm assembly below the respective first lift arms, each control link being positioned above the level of the coupling of the hydraulic actuators to the main frame and below the pivotal mounting s of the second lift arm link with the loader boom assembly in a lowered position, said control inks controlling the path of movement of the first and second articulated lift arm link assemblies, the respective control inks and hydraulic actuators being in registry with and underlying the lift arms on each respective side of the operator's compartment to maximize the available space for lateral width of the operators's compartment and to minimize overall width.

12. The skid steer loader of claim 11 wherein said second lift arm link assembly is substantially shorter than the first lift arm link assembly and substantially sorter than the control links, and up on raising of the first lift links by use of the hydraulic actuators, the control inks urge the second lift arm link assembly to first move the first lift arm link assembly rearwardly to remain close to eh front of the skid steer loader and then move the first lift arm link assembly forwardly upon further raising to control the path of movement of a working too.

13. The skid steer loader of claim 12 wherein the loader has a rear engine compartment and the second lift arm link assembly is positioned to be forwardly of the access door of the rear engine compartment.

14. The loader assembly of claim 11 wherein the second lift arm link assembly is substantially shorter than the first lift arm link assembly and provides a rigid support for pivoting of the first lift arm link assembly.

15. A lift boom assembly for a loader on a prime mover having a longitudinal main frame, a pair of lift arms located at opposite sides of the frame and coupled together to move as a lift arm assembly, said lift arm assembly having a forward end attachment for mounting a working tool and a rearward end, said pair of lift arms each comprising first and second articulated lift arm links, including a main lift arm link extending from the forward portion of the frame rearwardly, and a second lift arm link shorter than the main lift arm link having a first end pivotally mounted to a rearward end of the main lift arm link and having a second end pivotally mounted to the main frame adjacent a rear end of the main frame and substantially above a supporting surface for the main frame, extensible and retractable power actuator means coupled between the main lift arm links, respectively, and the prime mover and a control link connected to at least one lift arm for controlling the path of movement of the pivot between the respective main lift arm link and the second lift arm link as the lift arms are raised and lowered, sad control link having a first end pivotally mounted to the main frame at a first pivot point adjacent forward portions of the main frame and having a second end connected to the main lift arm link at a second pivot point, said second lift arm link extends upwardly and forwardly from its pivot to the rear of the frame to its pivot to the main lift arm link with the main lift arm link in a lowered position, and has a first included angel with respect to the main lift arm link in a lowered position, said control link being pivotally mounted to the main lift arm link through a second arm fixed to the main lift arm link which places the pivot point between the control link and the main lift arm link substantially offset downwardly from the pivotal connection between the main lift arm link and the second lift arm link on each side of the lift arm assembly with the lift arm assembly in a lowered position, the pivot point between the control link and second arm moving upwardly upon initial upward movement of the lift arm assembly and moving from a first side of a plane defined by the pivot at the first end of the control link and the pivot at the first end of the second lift arm link as the lift arm assembly moves upwardly such that the first included angle decreases under control of the control link as the main lift arm link is first raised and after the lift arm assembly is raised to a desired position the included angle increases.

16. A lift boom assembly for a loader on a prime mover having a longitudinal main frame, a pair of lift arms located at opposite side so the frame and coupled together to move as a lift arm assembly, said lift arm assembly having a forward end attachment for mounting a working tool and a rearward end, said pair of lift arms each comprising first and second articulated lift arm links, including a main lift arm link extending from the forward portion of the frame rearwardly, and a second lift arm link shorter than the main lift arm link having a first end pivotally mounted to a rearward end of the main lift arm link and having a second end pivotally mounted to the main frame adjacent a rear end of the main frame and substantially above a supporting surface for the main frame, extensible and retractable power actuator means coupled between the main lift arm links, respectively, and the prime mover, said actuator means having respective first ends pivotally mounted adjacent the rearward portions of the main frame at positions substantially below the pivot of the respective second link to the main frame, the actuator means having a second ends pivotally connected to the main lift arm links intermediate of the pivot connections thereof to the second link and the forward ends of the main lift arm links, respectively, and a control ink connected to at least one lift arm for controlling the path of movement of the pivot between the respective main lift arm link and the second lift arm link as the lift arms are raised and lowered, said control link having a first end pivotally mounted to the main frame adjacent forward portion of the main frame and having a second end connected to the main lift arm link at a position whereby the second pivot of the control link moves along an arc as the lift arm assembly is raised by the actuator means and the pivot between each main lift arm link and its respective second link moves in a controlled path which effectively extends the overall length of the tow lift arm links of each lift arm after the boom assembly is raised a selected amount.

* * * * *

UNITED STATES PATENT AND TRADEMARK OFFICE

CERTIFICATE OF CORRECTION

PATENT NO. : 5,169,278

DATED : December 8, 1992

INVENTOR(S) : LONNIE D. HOECHST, ORLAN J. LORAAS, WALLY L. KACZMARSK
LARRY E. ALBRIGHT

It is certified that error appears in the above-identified patent and that said Letters Patent is hereby corrected as shown below:

Col. 7, line 14, after "having", delete "a"

Col. 8, lines 17-18, delete "form in", insert "forming"

Col. 8, line 27, delete "sorter", insert "shorter"

Col. 8, line 35, delete "an", insert "and"

Col. 8, line 53, delete "maintaining", insert "maintain"

Col. 9, line 7, delete "f", insert "of"

Col. 9, line 9, delete "inks,", insert "links"

Col. 9, line 45, delete "inks,", insert "links"

Col. 9, line 56, delete "inks", insert "links"

Col. 9, line 59, delete "inks", insert "links"

Col. 9, line 67, delete "sorter", insert "shorter"

Col. 9, line 67, delete "up on", insert "upon"

Col. 10, line 1, delete "inks", insert "links"

Col. 10, line 3, delete "eh", insert "the"

Col. 10, line 6, delete "too.", insert "tool."

Col. 10, line 35, delete "sad", insert "said"

UNITED STATES PATENT AND TRADEMARK OFFICE

CERTIFICATE OF CORRECTION

PATENT NO. : 5,169,278

DATED : December 8, 1992

INVENTOR(S) : Lonnie D. Hoechst, Orlan J. Loraas, Wally L. Kaczmarski, Larry E. Albright It is certified that error appears in the above-indentified patent and that said Letters Patent is hereby corrected as shown below:

Col. 10, line 43, delete "angel", insert "angle"

Col. 10, line 64, delete "side so", insert "sides of"

Col. 12, line 14, delete "tow", insert "two"

Signed and Sealed this

Twenty-sixth Day of October, 1993

*Attest:*

Bruce Lehman

BRUCE LEHMAN

*Attesting Officer*

*Commissioner of Patents and Trademarks*